US007228676B2

(12) United States Patent
Davis et al.

(10) Patent No.: US 7,228,676 B2
(45) Date of Patent: Jun. 12, 2007

(54) TABLET ENCAPSULATING MACHINE

(75) Inventors: Glenn Davis, Wyoming, MI (US); Craig M. Vugteveen, West Olive, MI (US)

(73) Assignee: L. Perrigo Company, Allegan, MI (US)

( * ) Notice: Subject to any disclaimer, the term of this patent is extended or adjusted under 35 U.S.C. 154(b) by 236 days.

(21) Appl. No.: 10/899,924

(22) Filed: Jul. 27, 2004

(65) Prior Publication Data

US 2005/0034428 A1 Feb. 17, 2005

Related U.S. Application Data

(60) Provisional application No. 60/490,914, filed on Jul. 29, 2003.

(51) Int. Cl.
*B65B 9/04* (2006.01)
*B65B 47/00* (2006.01)

(52) U.S. Cl. ..... 53/560; 53/900

(58) Field of Classification Search ..... 53/454, 53/560, 900; 225/804
See application file for complete search history.

(56) References Cited

U.S. PATENT DOCUMENTS 1,654,647 A * 1/1928 Heist ..... 156/199
2,155,444 A 4/1939 Pittenger et al.
2,155,445 A 4/1939 Pittenger et al.
2,307,051 A * 1/1943 Litton et al. ..... 428/676
2,318,718 A * 5/1943 Scherer ..... 53/451
2,513,852 A 7/1950 Donofrio
2,624,163 A 1/1953 Stirn
2,663,128 A 12/1953 Stirn et al.
2,775,080 A 12/1956 Stirn et al.
2,775,081 A 12/1956 Stim et al.
3,046,605 A 7/1962 Greif et al.
3,221,472 A * 12/1965 Groth et al. ..... 53/559

(Continued)

FOREIGN PATENT DOCUMENTS

IT 538281 1/1956

OTHER PUBLICATIONS

*The Theory and Practice of Industrial Pharmacy*, First Edition, 1970, pp. 359-384.

(Continued)

*Primary Examiner*—John Sipos
(74) *Attorney, Agent, or Firm*—Price, Heneveld, Cooper, DeWitt & Litton, LLP

(57) ABSTRACT

An encapsulating machine includes a pair of offset die rolls with one die roll mounted on slides urged by an adjustable fulcrum spring toward the other die roll. An offset drive coupling between the axle of the die roll and the associated drive shaft allows independent movement of the die axle to compensate for die wear. A split gear between die roll shafts accommodates for backlash and gear wear. Precise pulley-driven timing belts and phase adjusters extend between the die roll drive and a tablet feed roll to synchronize the clocked introduction of tablets onto film of one of the die rolls for encapsulation at the co-acting nip between the die rolls. The die cavities for tablets include a step-cut to improve the sealing of films around the tablets and a circumferential rub rail on opposite edges of each die prevents excessive wear of the die cavity lands.

13 Claims, 15 Drawing Sheets

U.S. PATENT DOCUMENTS

| | | | | | |
|---|---|---|---|---|---|
| 3,232,024 | A | * | 2/1966 | Brown | 53/559 |
| 3,353,329 | A | * | 11/1967 | Cloud et al. | 53/453 |
| 3,481,100 | A | * | 12/1969 | Bergstrom | 53/433 |
| 4,154,636 | A | | 5/1979 | Motoyama et al. | |
| 4,375,146 | A | * | 3/1983 | Chung | 53/453 |
| 4,567,714 | A | | 2/1986 | Chasman | |
| 4,728,477 | A | * | 3/1988 | Dromigny | 264/509 |
| 4,820,524 | A | | 4/1989 | Berta | |
| 4,965,089 | A | | 10/1990 | Sauter et al. | |
| 5,146,730 | A | | 9/1992 | Sadek et al. | |
| 5,459,983 | A | | 10/1995 | Sadek et al. | |
| 5,682,733 | A | * | 11/1997 | Perrone | 53/560 |
| 5,813,197 | A | * | 9/1998 | Aguzzoli | 53/453 |
| 6,018,935 | A | | 2/2000 | Perrone | |
| 6,167,684 | B1 | | 1/2001 | Perrone | |
| 6,209,296 | B1 | | 4/2001 | Perrone | |
| 6,295,793 | B1 | * | 10/2001 | Takayanagi | 53/454 |
| 6,482,516 | B1 | | 11/2002 | Sadek et al. | |
| 6,591,585 | B2 | * | 7/2003 | Stolz | 53/454 |

OTHER PUBLICATIONS

*The Theory and Practice of Industrial Pharmacy*, Second Edition, 1976, pp. 404-420.

*The Theory and Practice of Industrial Pharmacy*, Third Edition, 1986, pp. 398-412.

*Pharmaceutical Technology*, "Soft elastic gelatin capsules: a unique dosage form", Oct. 1977, pp. 44-50.

*Packaging Technology*, vol. 17, No. 2, Mar./Apr. 1987, pp. 3, 4, 7, and 16.

*Specialized Drug Delivery Systems*, Chapter 10 "Softgels: Manufacturing Considerations", pp. 409-449, 1990.

*Pharmaceutical Technology*, "Soft gelatin capsules: a solution to many tableting problems", H. Seager, Sep. 1985.

*Journal of Pharmaceutical Sciences*, vol. 53, No. 7, Jul. 1964, pp. 777-782.

* cited by examiner

TABLET ENCAPSULATING MACHINE

CROSS-REFERENCE TO RELATED APPLICATIONS

This application claims priority under 35 U.S.C. § 119(e) on U.S. Provisional Application No. 60/490,914 entitled TABLET ENCAPSULATING MACHINE, filed on Jul. 29, 2003, by Glenn Davis and Craig M. Vugteveen, the entire disclosure of which is incorporated herein by reference.

BACKGROUND OF THE INVENTION

The present invention relates to an encapsulating machine and particularly to an improved machine employing a pair of offset die rolls for, in one embodiment, encapsulating medicinal tablets with a plastic film material, such as gelatin.

As used herein, the term "tablet" refers to a preformed shape, such as a round tablet or an elongated tablet frequently referred to as a caplet. When a medicament, such tablets are preformed in conventional tabletting presses and typically include excipients and fillers in addition to the active ingredients. Encapsulating such tablets with plastic films, such as gelatin, has been well known since the early 1950's, as disclosed in U.S. Pat. No. 2,775,081 showing equipment employing two offset die rolls, one of which transports tablets positioned on a gelatin film into the nip between the die rolls for encapsulation of the tablets by a second gelatin film on the other of the die rolls. In order to adjust the pressure between the die rolls for proper sealing of the film around the tablets, one of the die roll drive shafts has bearings mounted in elongated slots which bearings are urged by a pin and spring mechanism to provide an adjustable pressure between the die rolls.

Although such a system provides a basic adjustment mechanism for pressure between co-acting dies in a tablet encapsulating machine, it does not easily accommodate for changes due to wear of the die rolls during use of the machine nor does it accommodate dynamic lateral adjustability of one die roll to the other.

More current tablet encapsulating machines are disclosed in, for example, U.S. Pat. No. 6,209,296, which includes direct gear-driven die rolls and tablet feeding mechanism to synchronize the depositing of tablets on one gelatin film prior to introduction into the nip between two die rolls. Although such a system provides clocked and synchronized depositing of tablets onto a gelatin film, the use of direct gear-driven die rolls and the tablet feeding mechanism will, during use, cause wear and backlash between the numerous gears employed. Such a system is not easily adjustable to allow resynchronization of the introduction of tablets into the die rolls upon wear of the gears.

Also, tablet encapsulating machines employ rolls, known as mangle rolls, to grab and remove the webs of encapsulating film from the die rolls once the encapsulated tablets have been remove from the films which are, at this time, laminated to one another. On occasion, the mangle rolls become jammed with the web material necessitating stopping of the entire machine while the jam is cleared. This leads to undesirable down time during a production run. There exists a need, therefore, for an improved web take-up system which is less prone to jamming and, if jammed, can be easily and quickly cleared.

Further, with existing die rolls, some difficulties have been encountered forming a tight peripheral seal of the gelatin film on preforms as well as wear on the die rolls during use.

Thus, there remains a need for a tablet encapsulating machine of the type which deposits tablets on a gelatin film in advanced of the nip between die rolls having cavities for encapsulating tablets with plastic film material, such as gelatin, around the tablets, and which can accommodate continued use of the machine, including the wear of the co-acting dies themselves. There also exists a need for an encapsulating machine which easily accommodates adjustment for synchronizing the clocked positioning of tablets on one sheet of plastic film on a die roller, including precise positioning with respect to the tablet die cavity therein and one which efficiently seals the preform tablets and subsequently removes the web material from the die rolls.

SUMMARY OF THE INVENTION

The system of the present invention accommodates these needs by providing an adjustable double fulcrum spring pressure between die rolls which replaces the constant pressure system of the prior art to compensate for surface variations at the point of contact between the dies and an adjustable offset drive coupling between the axle of at least one of the die rolls and the associated drive shaft to allow for independent movement of the die axle to compensate for die wear. Additionally, the system of the present invention replaces several direct gear-driven couplings between the various drives and tablet feed roll with precise pulley-driven timing belts and phase adjusters, which allow greater flexibility in synchronizing the clocked introduction of tablets onto a film on one of the die rolls for subsequent encapsulation at the co-acting nip between the die rolls. A gear coupling employed between die roll shafts includes an adjustable split gear to accommodate for backlash and gear wear. Further, in one embodiment, the die cavities for the tablets include a step-cut to improve the sealing of the films around the preformed tablets. Also, in one embodiment, a circumferential rub rail is provided on opposite edges of each die to prevent excessive wear of die cavity lands.

These and other features, objects and advantages of the present invention will become apparent upon reading the following description thereof together with reference to the accompanying drawings.

DETAILED DESCRIPTION OF THE PREFERRED EMBODIMENT

Figure 1:
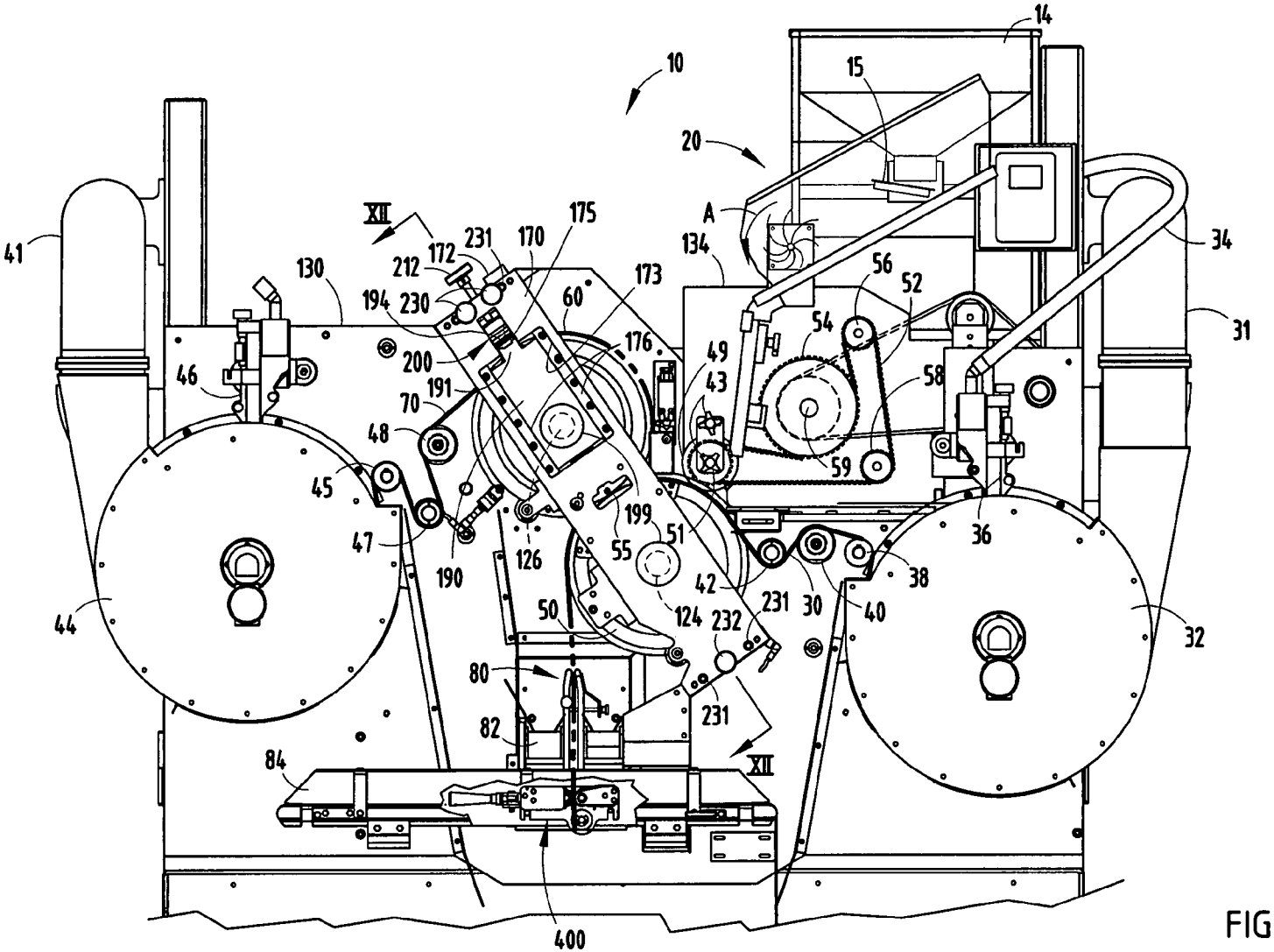
FIG. 1 is a front elevational view, partly broken away, of an encapsulating machine embodying the present inventions.

Referring initially to FIG. 1, a brief description of the preform tablet encapsulating machine 10 embodying the present invention is first presented, followed by a detailed description of the components. Machine 10 receives preforms (i.e., compacted tablets) in the form of round or caplet-shaped individual tablets 12 (FIG. 2), which are supplied from a hopper 14 into a tray 22 of tablet-feeding assembly 20 (shown in detail in FIG. 2). Tablets from the tablet-feeding assembly, which is described in greater detail below, are applied to a first gelatin web or film 30 cast by a first casting drum assembly 32 which receives heated liquid gelatin from a supply 34 and applies it to the casting drum with a spreader box blade 36. The first gelatin film is taken from casting drum assembly 32 by a take-off roller 38, an oiler roller 40 which applies mineral oil to the surface of the film 30 which contacts the lower die roll 50. The film also passes over an idler roller 42. Tablets 12 from the tablet-feeding assembly 20 are deposited in rows onto an index roll 49 (FIGS. 1 and 2), which transfers the preformed tablets onto the gelatin film 30 at a location on lower die roll 50 approximately 60° from (i.e., upstream of) the nip 55 which is the junction between the lower die roll 50 and the upper die roll 60.

A second gelatin film 70 is formed on a second casting drum assembly 44 from a supply of liquid gelatin by a second spreader blade 46. The second film 70 is removed from casting drum 44 by take-off roller 45, idler roller 47, and an oiler roller 48, which applies mineral oil to the surface of gelatin film 70 which engages the surface of upper die roll 60. The die rolls rotate in opposite directions, with the lower die roll 50 rotating in a counterclockwise direction, as seen in FIG. 1, while the upper die roll 60 rotates in a clockwise direction to encapsulate the preforms 12 between the gelatin films 30 and 70.

Figure 22:
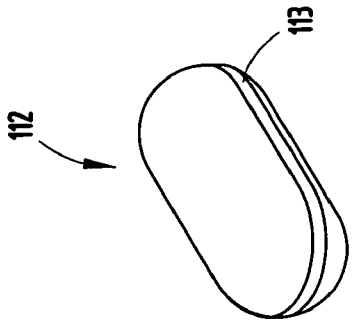
FIG. 22 is an enlarged perspective view of an encapsulated caplet made with the machine of the present invention.

The encapsulated preforms 112 (shown in FIG. 22) fall from the web of gelatin films onto a collection belt 82 from the die roll area out to a discharge conveyor 84 for subsequent collection and drying. The web of gelatin films 30, 70 travels through a chute assembly 80, which includes hex rollers to free any remaining encapsulated preforms from the web. The chute assembly 80 is commercially available and well known in the art. The now laminated web of films 30 and 70 travels through the chute assembly 80 into a mangle roll assembly 400, described below in connection with FIGS. 19-21, which draws the web from the machine for collection and recycling.

Figure 2:
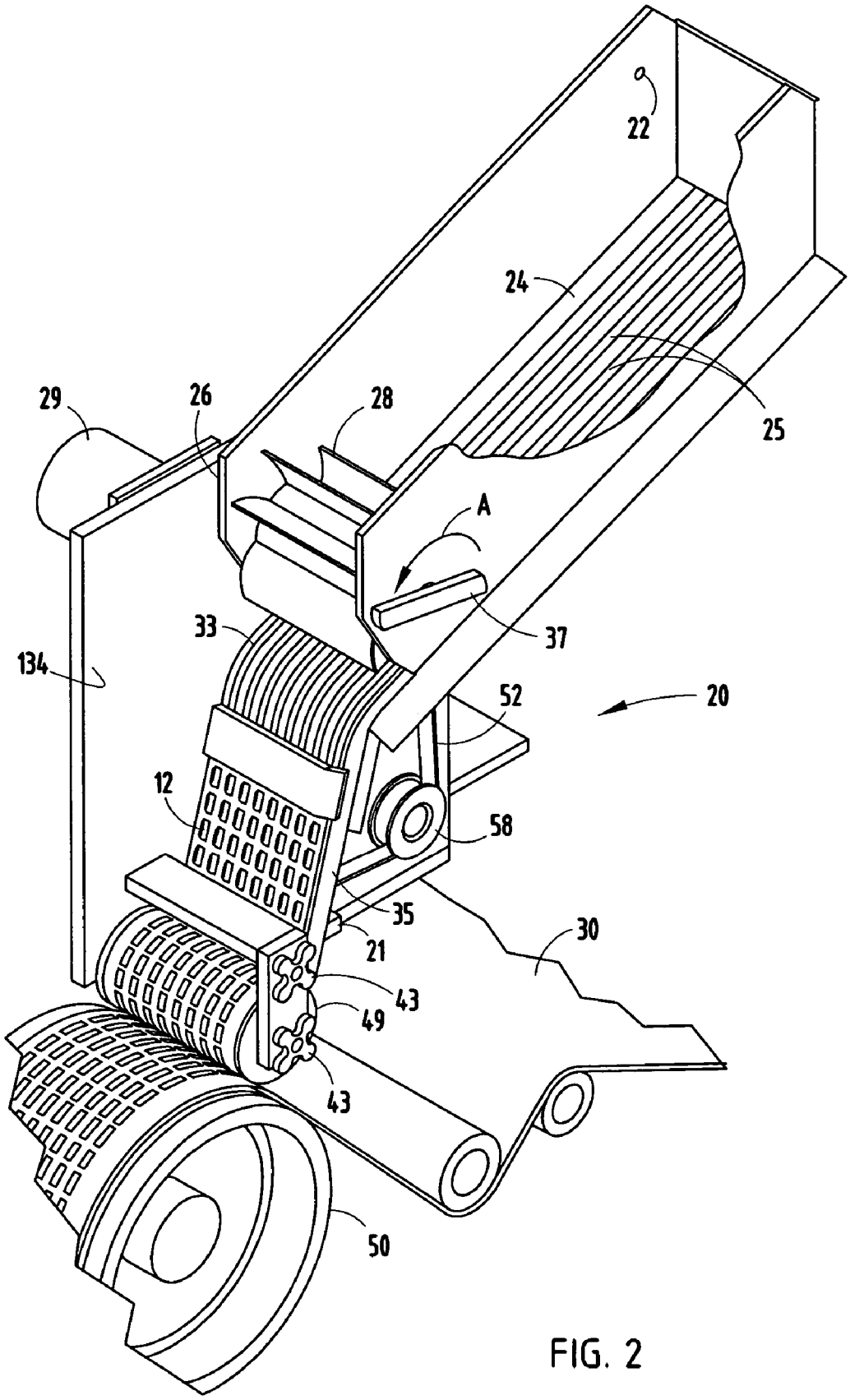
FIG. 2 is a perspective view, partly broken away, of the tablet feed mechanism, seen also in FIG. 1.

In addition to these basic components, the casting drum assemblies 32 and 44 conventionally include cooling air ducts 31 and 41, as well as liquid cooling jackets to provide the gelatin films 30 and 70 with the desired degree of plasticity for use on the die rolls for encapsulating preforms. The gelatin film is a conventional composition of gelatin and plasticizer, such as glycerin, and films 30, 70 can have differing characteristics, such as different colors for providing product identification for a particular preform tablet being encapsulated. Medicaments, such as analgesics and analgesics combined with other common active ingredients, are typical preforms. Such tablets are frequently manufactured at a site other than the location of the encapsulating machine and are positioned in hopper 14 for feeding the machine 10. The preforms exit the hopper 14 and are transported by pan 15 into tray 22, which has a floor 24 with a plurality of longitudinally extending grooves 25, as seen in FIG. 2. The tablets generally are aligned longitudinally and vertically on their edge within parallel longitudinally extending grooves 25 in the floor 24 of tray 22. Floor 24 is inclined at an angle of approximately 45°, as best seen in FIG. 1, and includes a discharge end 26 including a brush 28 which rotates in a counterclockwise direction, as seen by arrow A in FIG. 2, and is driven by motor 29 to brush away preforms which are not so aligned.

The preforms slide by gravity down tray 22 and are discharged from end 26 of the tray into a helix 33. Helix 33 is a chute that rotates the preforms 90° to place them in a covered, downwardly depending chute 35 in proper alignment for transfer onto index roll 49. Index roll 49 includes a drive pulley 51 (FIG. 1) which is driven by a double-sided drive belt 52 extending around a main drive pulley 54 and a pair of idler rollers 56 and 58. Main drive pulley 54 is driven by a shaft 59 extending from a belt-driven pulley as described below.

The tablet-feeding assembly 20 also includes a pin stop block 21 which is positioned near the discharge end of chute 35, which provides movable blocking pins extending through chute 35 to stop the flow of preforms through chute 35 onto index roll 49 when a preform shape changeover is being made (e.g., from a caplet to a round tablet), which necessitates the changing of die rolls 50 and 60 as well as the tablet-feeding assembly 20 and index roll 49. Conveniently, the tablet-feeding apparatus is mounted by a quick disconnect threaded handle 37 (FIG. 2) to a plate 134 of the feeder while the index roll 49 is also quickly assembled to plate 134 by the use of quick disconnect threaded handles 43, as seen in FIGS. 1 and 2. The index roll drive shaft 59 is precisely timed with the die roll drive mechanism to assure that the preforms 12 are synchronously positioned on the gelatin film 30 covering the lower die roll 50 in precise alignment with the mold cavities 100 of the die rolls by the drive mechanism subsequently described. In place of the gravity fed tablet-feeding assembly 20, a commercially available Hartnett tablet feeding apparatus, manufactured by R. W. Hartnett Company, can be employed to transfer preforms from hopper 14 onto the index roll 49 and subsequently onto the gelatin film 30.

Figure 3:
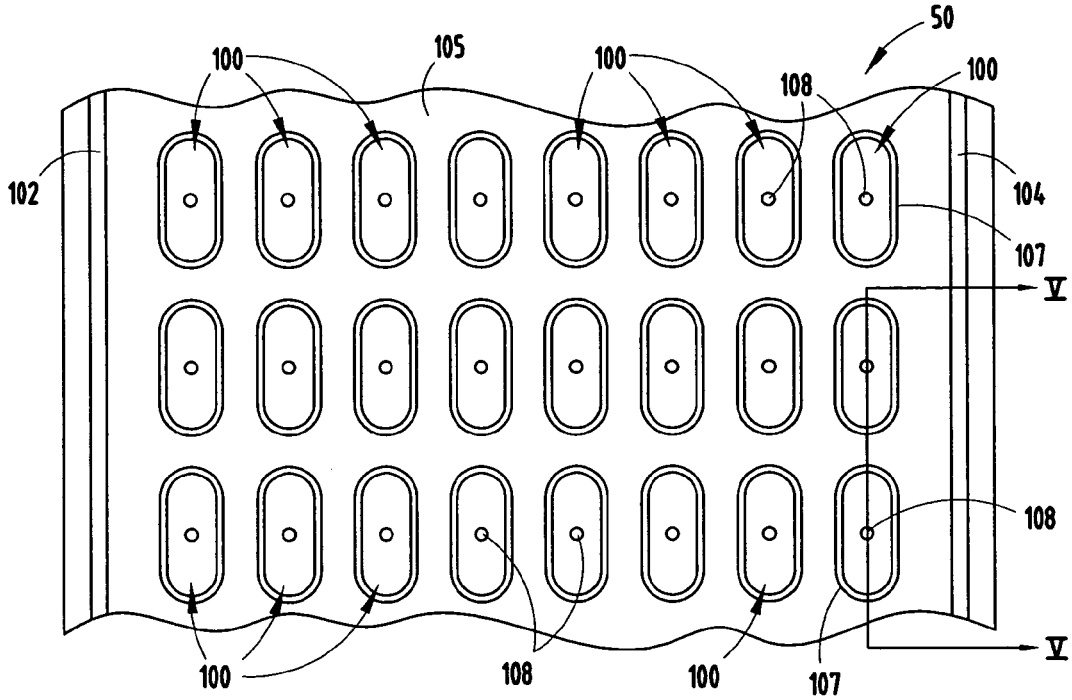
FIG. 3 is an enlarged fragmentary plan view of one of the die rolls, showing the die cavities therein.
Figure 4:
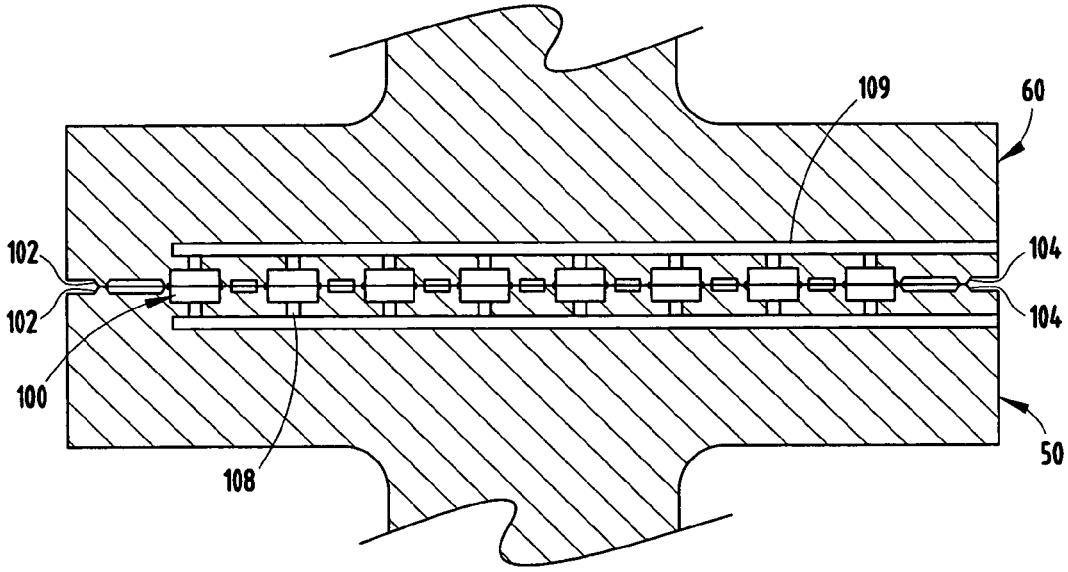
FIG. 4 is a fragmentary cross-sectional view of the mating upper and lower die rolls.

Each of die rolls 50 and 60 include, depending upon the shape of the preformed tablets, from about 39 to about 54 rows of mold cavities 100 (FIG. 3), with each row including from 7 to 8 mold cavities, again depending upon the preform shape being encapsulated. FIG. 3 is an enlarged fragmentary view of a section of die roll 50 with mold cavities 100 for receiving caplet-shaped tablets. Each of the die rolls 50, 60 include a die surface 105 which is recessed from the lands 107 surrounding each of the die cavities 100. The lands having a height above surface 105 of from about 0.015 inches to about 0.063 inches, which varies as the dies are used and resurfaced. The land 107, as shown in FIG. 3, circumscribes a general caplet shape, and the floor 103 of each die cavity 100 includes an aperture 108, which communicates with a manifold 109 (FIG. 4), which can lead to a vacuum source or otherwise exhaust air from the mold cavities during the encapsulation process. Each of the die rolls 50, 60 also include circumferentially extending rub rails 102, 104 positioned near the outer edges of the die rolls to span opposite sides of the rows of mold cavities 100. Rails 102, 104 extend upwardly from the surface 105 of the respective dies substantially the same distance as lands 107 to provide additional wear surfaces for the co-acting dies as seen in FIG. 4, where the mating rub rails 102 and 104 on each side, respectively, engage one another as do the mating lands 107 of each die cavity 100.

Figure 5:
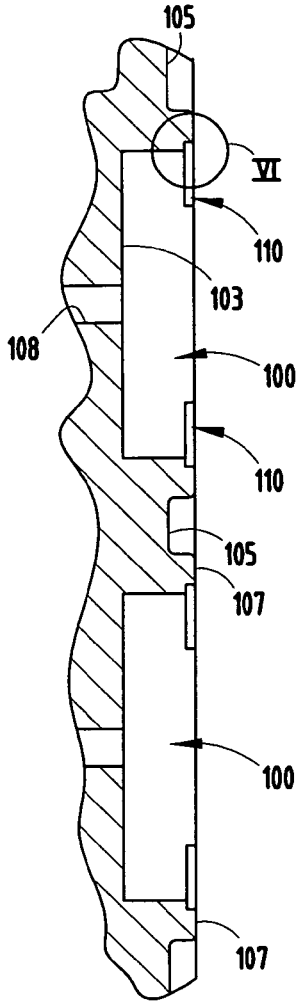
FIG. 5 is a greatly enlarged cross-sectional view of the die rolls shown in FIG. 3, taken along section line V-V of FIG. 3.
Figure 6:
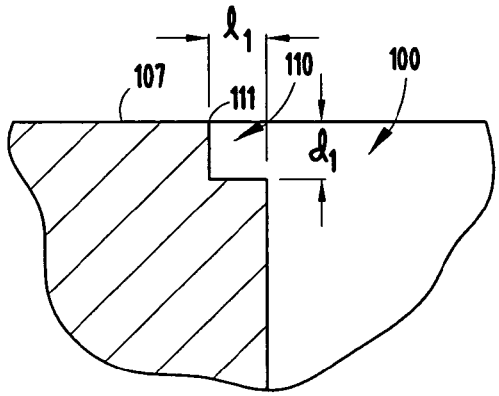
FIG. 6 is a greatly enlarged view of the circled area VI shown in FIG. 5.

In order to improve the peripheral seal 113 around the encapsulated tablet 112 (FIG. 22), the inner edge (i.e., facing edges) of each of the lands 107 includes a step-cut 110, as best seen in FIG. 6. The mold cavities for the caplets, as seen in FIG. 3, include such a step-cut around the opposite ends. The ends of the caplet, which are tightly curved, have in the past been somewhat problematical with respect to forming a perfect seal of the two gelatin films. By providing a step-cut 110 in the areas of the curved section of mold cavities 100, the gelatin or other films are pinched together before the cutting edge 111 of the die roll cuts the film material. For such purpose, the step-cut 110 has a depth $d_1$ of about 0.007 inches and a lateral dimension $l_1$ of about 0.010 inches. Generally, the step cut 110 will have a depth of about 64% of the initial thickness of the gelatin film. For the 0.011 film employed in one embodiment, $d_1$ was 0.007 inches. As seen in FIG. 5, the step-cut 110 at each end circumscribes only the curved end portions with the straight sides of each of the mold cavities 100 being slightly chamfered. Mold cavity 100 is of sufficient size and shape to accommodate half of each of the caplets placed therein during the encapsulation process at the die nip, as illustrated in FIG. 4, without crushing the preformed core.

Figure 8:
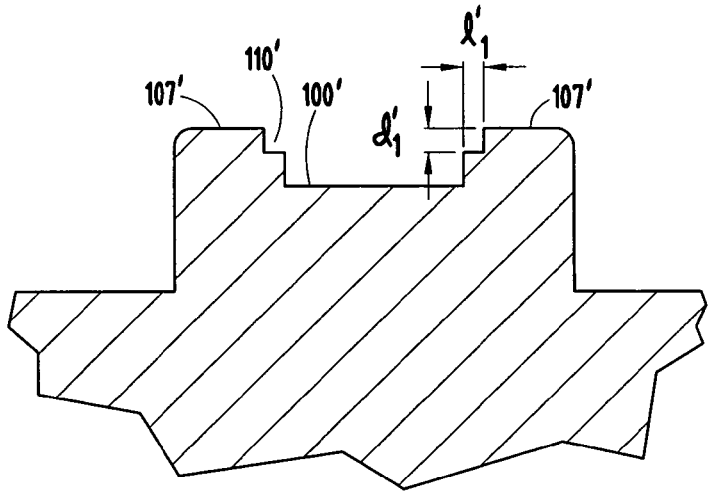
FIG. 8 is a cross-sectional view through one of the die cavities shown in FIG. 7, taken along section line VIII-VIII in FIG. 7.
Figure 7:
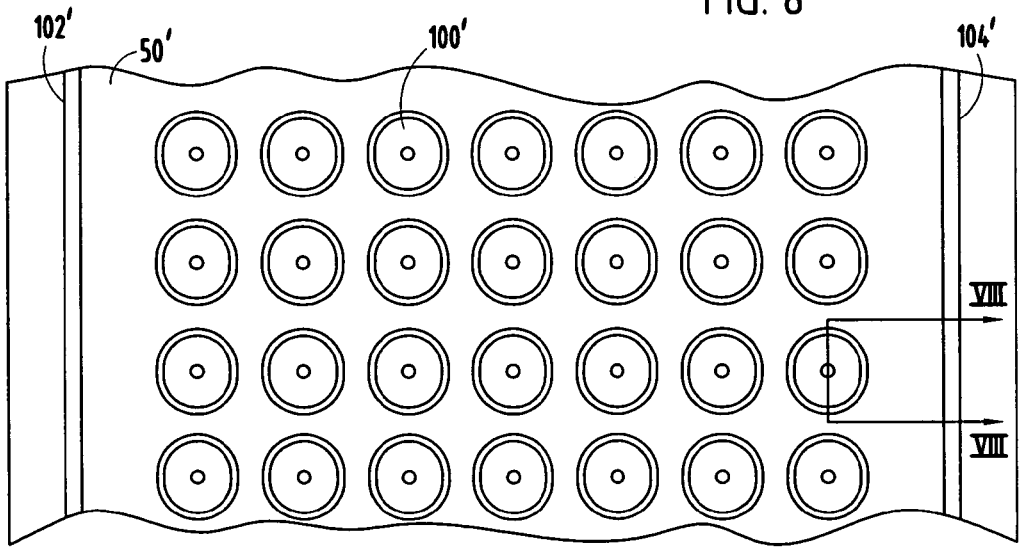
FIG. 7 is a fragmentary plan view of a die roll used for a different shaped preform.

When encapsulating other shapes such as small oblong tablets or round tablets, similar dies, such as upper die 50' (FIGS. 7 and 8), are employed with die cavities 100'. With the rounder die cavities 100' shown in FIG. 7, a row of only 7 cavities is possible, however, for small preforms, 54 such rows can be accommodated on the 12-inch diameter die rolls. Similarly, if larger round tablets are being encapsulated, frequently only 48 rows can be accommodated. Die 50' and its mating upper die (not shown) also include rub rails 102' and 104'. The individual die cavities 100' include lands 107' with step-cuts 110', as seen in FIG. 8, extending around the entire periphery of the curved die cavity. With the step-cut 110' for round tablets, typically the depth of the step-cut $d_1'$ will be 0.007 inches, while the lateral dimension $l_1'$ will be about 0.006 inches, somewhat less than for the lateral cut in the caplet die cavity 100 shown in FIGS. 3 and 6.

The 12-inch diameter die rolls 50, 60 are rotated at a speed of from about 2 RPM to about 5.8 RPM. With caplets having 8 die cavities in each of 39 rows, 312 caplets are formed for each revolution, such that at the preferred speed of 4 RPM, for example, 1248 caplet preforms per minute are encapsulated. The die rolls typically are made of aluminum, which have Teflon®-bonded hard anodized surfaces hardened to a Rockwell C hardness of 60 to provide improved wear characteristics for the die rolls. The throughput at 4 RPM speed for small tablets which have 54 rows of 7 die cavities is approximately 1512 tablets per minute, while for the larger tablets, which have 48 rows of 7 die cavities, is approximately 1344 tablets per minute.

Figure 9:
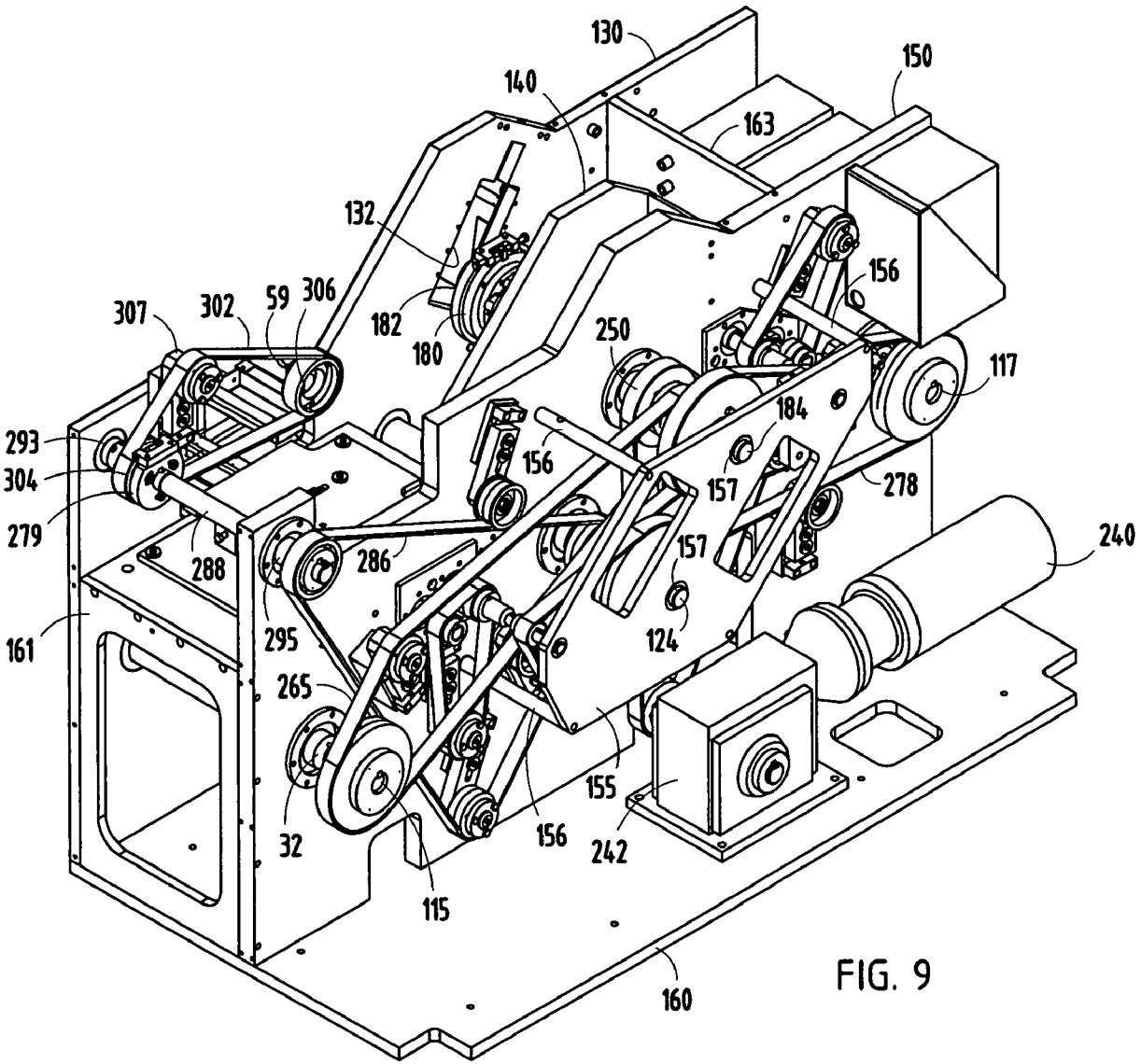
FIG. 9 is a rear upper perspective view of the machine, partly disassembled to show components of the drive system.
Figure 10:
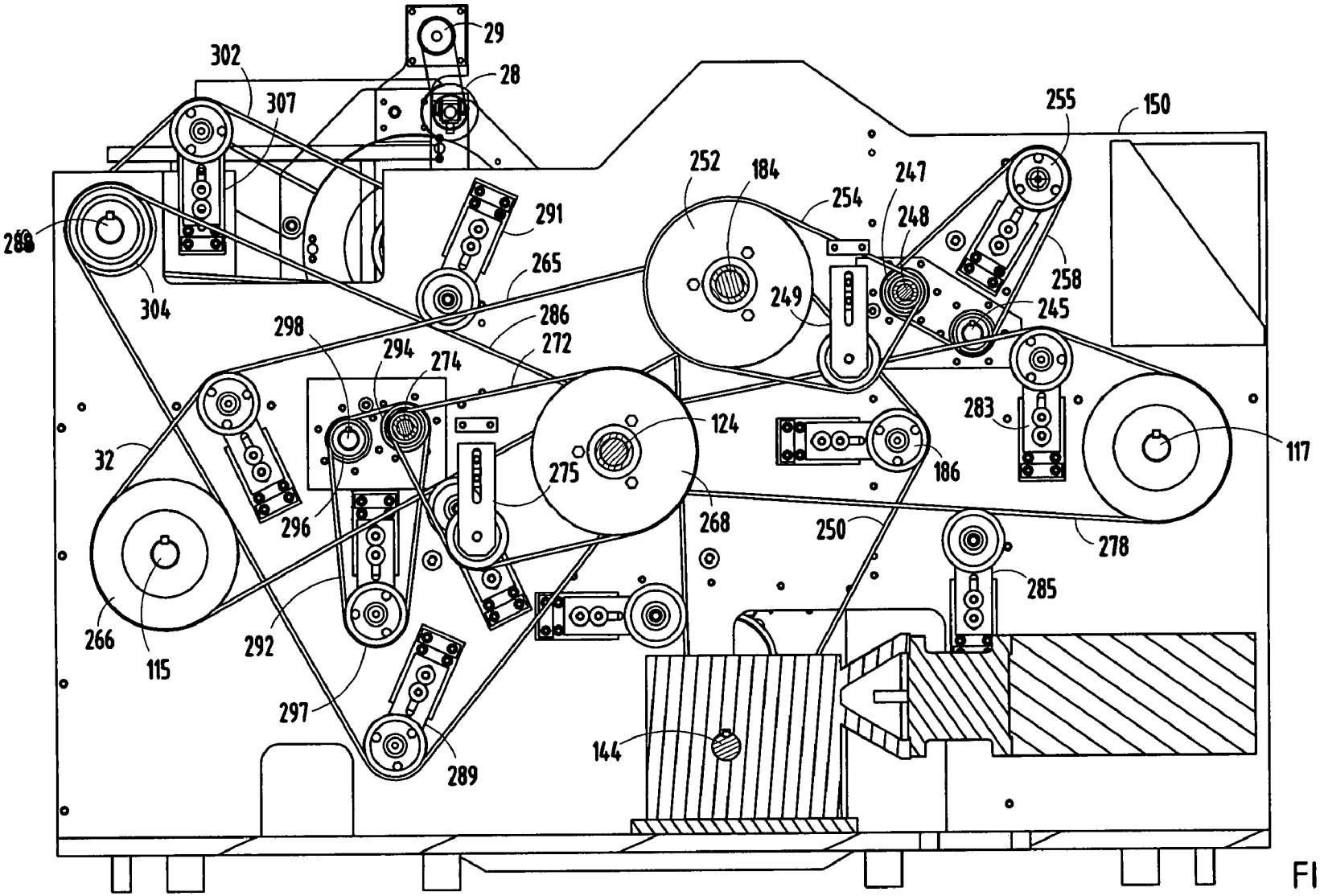
FIG. 10 is a vertical cross-sectional view of the rear of the machine with the end plate removed.
Figure 11:
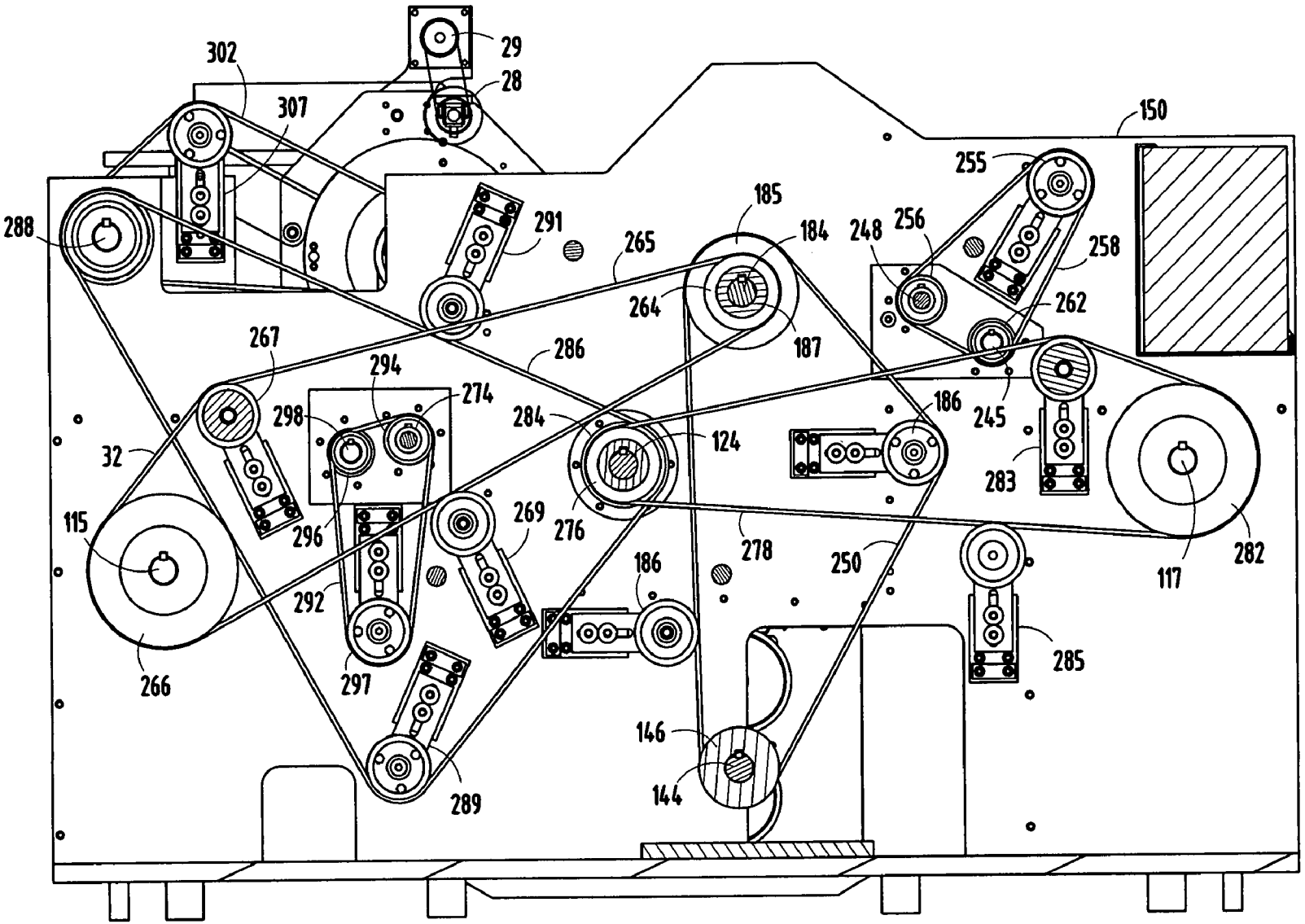
FIG. 11 is a vertical cross-sectional view of the rear of the machine, taken more toward the front than FIG. 9 to show drive belt interconnections.

Machine 10 includes a framework, including vertically extending, horizontally spaced walls 130, 140, and 150, extending upwardly from floor 160 (FIGS. 9-11). Floor 160 may be supported on a stand having suitable legs (not shown in FIG. 1). The vertical walls are supported by several cross partitions, including partitions such as 161-163, at suitable locations to provide structural rigidity to the framework defined for supporting the various drive components shown in FIGS. 9-11. Mounted in spaced relationship to the front wall 130 of machine 10 is a vertically extending outside die roll mounting plate 170 (FIGS. 1 and 12) secured at its upper end to plate 172 extending from wall 130 and at its lower end to plate 174, also extending from wall 130, to position plate 170 in spaced relationship to the outside of wall 130 to receive and support upper and lower die rolls 60 and 50, respectively.

Figure 12:
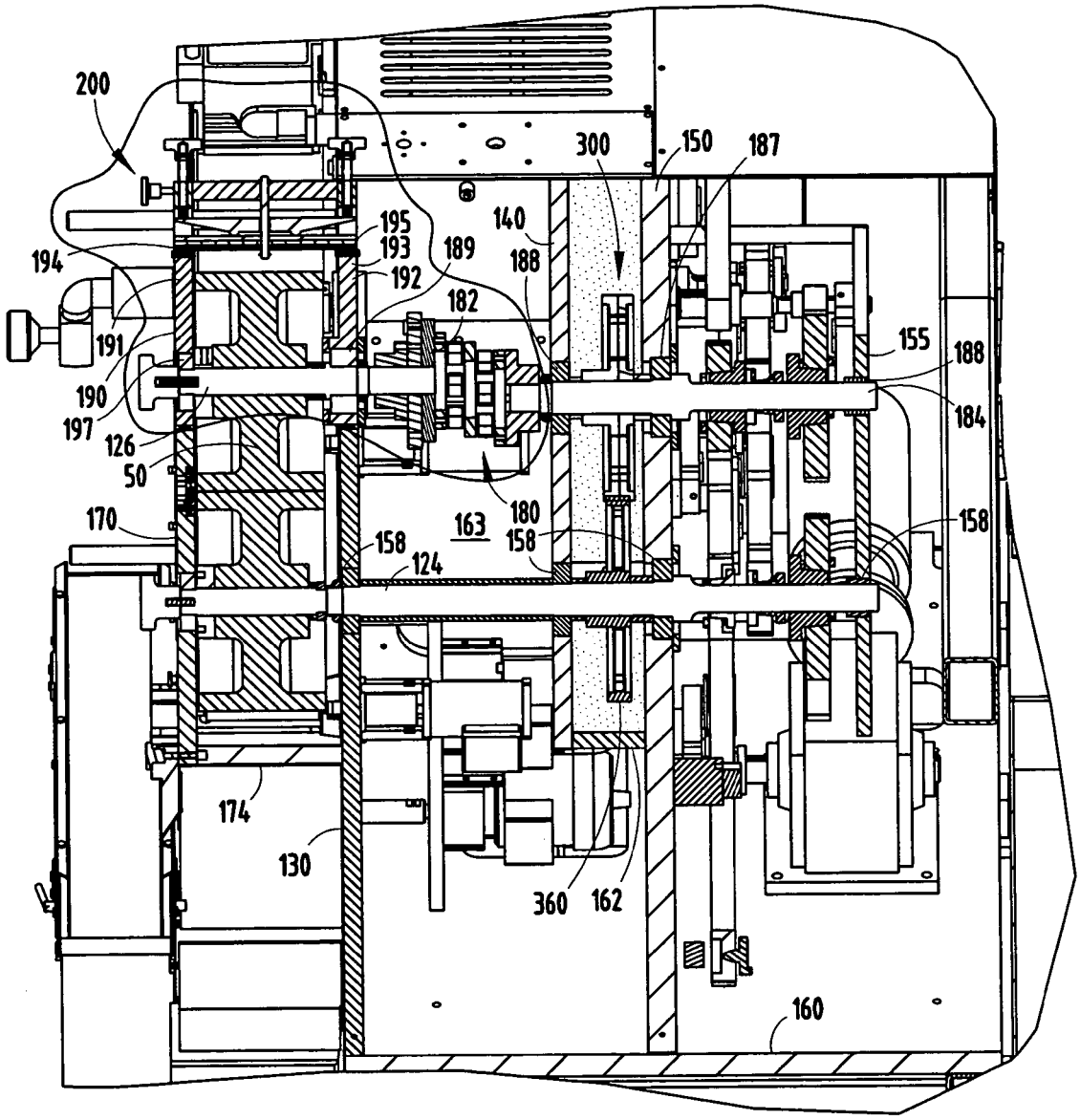
FIG. 12 is an enlarged cross-sectional view of the machine taken along section line XII-XII of FIG. 1.

Walls 130 and 150 include suitable apertures for receiving the bearings for supporting drive shafts 115 and 117 (FIGS. 9-11) for gelatin film-forming drums 32 and 44, respectively. As best seen in FIG. 12, walls 130, 140, and 150, as well as rear end plate 155, include apertures receiving bearings 158 for the axle 124 of the lower die roll 50. Wall 130 includes an elongated slotted aperture 132 (FIG. 9) for receiving a sliding plate 192 having a bearing 189 (FIG. 12) which is aligned with a Schmidt offset coupling 180 and phase adjusting hub 182 for coupling to the axle 126 (FIG. 12) of upper die roll 60. Plate 170 includes a similarly configured elongated slotted aperture 173 (FIG. 1) aligned with slotted aperture 132 in wall 130 for receiving sliding plate 190 with a bearing 197 (FIG. 12), such that the upper die roll 60 can be adjustable mounted by means of a pair of spring-loaded sliding plates 190 and 192 (FIGS. 1, 12, and 18) for adjustment toward and away from the lower die roll 50 by utilization of the fulcrum spring mounting assembly 200, shown in FIGS. 1, 12, and 18. This allows the adjustment and lateral control of the upper die roll 60 with respect to the lower die roll 50 to accommodate for die wear, gelatin thickness, and protects the dies against damage due to a misaligned preform by allowing movement of the spring-loaded upper die roll 60 in such an event.

Figure 18:
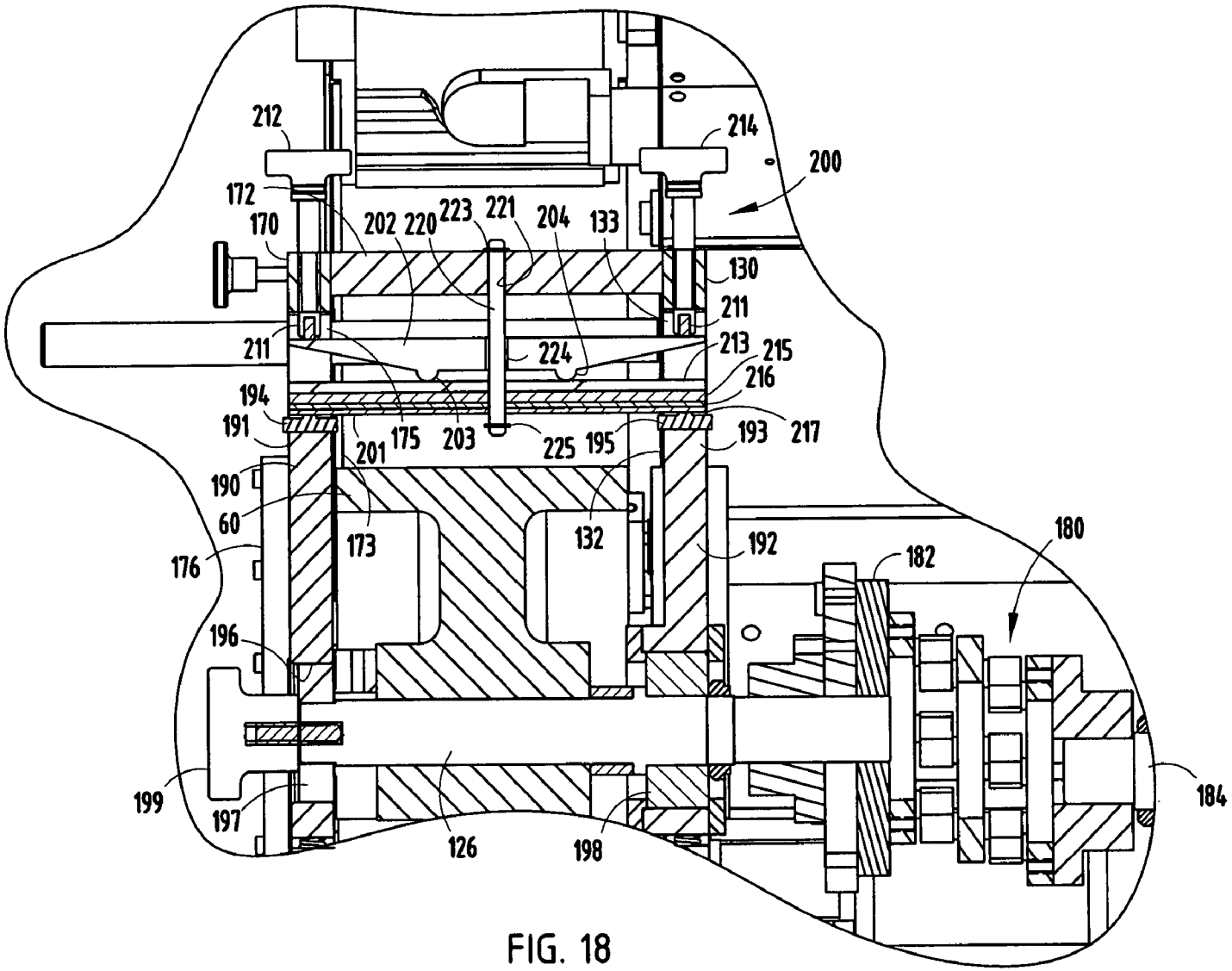
FIG. 18 is a greatly enlarged fragmentary vertical cross-sectional view of the upper die roll spring adjustment mechanism, shown also in FIG. 12.

Sliding plates 190 and 192, as best seen in FIGS. 1, 12, and 18, are generally rectangular and slide within apertures 173 and 132, respectively. Each plate includes an upwardly extending narrowed extensions 191 and 193 (respectively) having upper surfaces 194 and 195 (FIGS. 1, 12 and 18) which engage the lower surface 201 of a fulcrum spring assembly 200 (FIGS. 1, 12, and 18) extending between extensions 191 and 193 and the tips 211 (FIG. 18) of a pair of adjustment screws 212 and 214. Adjustment screws are received in threaded apertures in upper ends of plate 170 and wall 130 in alignment with the narrowed slots 175 and 133 receiving extensions 191 and 193 (FIGS. 1 and 18) of sliding axle-receiving plates 190 and 192. Sliding plates 190 and 192 are captively held within slots 173 and 132 by suitable guide plates 176 (FIG. 1) and gibbs (not shown) which hold the slide plates in lateral sliding relationship to plate 170 and wall 130.

Spring assembly 200 includes, as best seen in FIG. 18, a generally trapezoidal spring steel member 202, with a pair of spaced-apart raised semicylindrical center extensions 203 and 204 which engage stacked flat leaf springs 213, 215, 216, and 217 of differing thicknesses of spring steel for adjustability, as shown in FIG. 18. Spring member 202 is employed as the top spring with the semicylindrical sections 203 and 204 providing a double fulcrum connection to flat leaf springs 213, 215, 216, and 217, which rest upon the top surface 194 of extension 191 of plate 190 or 195 of extension 193 of plate 192, as best seen in FIG. 18. Adjustment screws 212 and 214 extend through threaded apertures in outer wall 170 and wall 130 and can be adjusted to provide a compressive force through spring 202 and leaf springs 213, 215, 216, and 217 to die roll 60 to adjust the pressure between die roll 60 and die roll 50 to approximately 1,200 pound force during encapsulation of a preform.

Spring steel plates 213, 215, 216, and 217 can have a thickness ranging from 1/16" to 3/8" and are stacked as desired to provide the amount of force adjustment for a given translation of slides 190 and 192 within their respective slots 173 and 132, respectively. Adjustment of the screws 212, 214 provides a very fine incremental adjustment of the pressure between the die rolls. By providing pivoted connections of spring 202 with contacts 203 and 204 to leaf springs 213, 215, 216, and 217 and to sliding plates 190 and 192 to which the axle 126 of die roll 60 is mounted, die roll 60 can accommodate unevenness and wear between the die rolls and remain in substantially uniform contact across the width of both die rolls 60 and 50 during operation. Suitable strain gauges and associated readout displays (not shown) allow an operator to monitor and control the pressure between die rolls 50, 60.

The spring assembly 200 includes a pin 220 which slidably extends through an aperture 221 in plate 172 and includes a slip washer 223 thereon. Pin 220 extends loosely downwardly through an aperture 224 in spring 202 and apertures through springs 213, 215, 216, and 217 and is captively held in place with a second slip washer 225. Pin 220 serves to captively hold the spring 202 and leaf springs in place in the slot 173 in plate 170 and corresponding slot 132 in wall 130.

The sliding plate 190 includes a bearing-receiving aperture 196 (FIG. 18) for receiving a bearing 197 for die roll 60 axle 126 supporting the axle within the sliding plate 190 at the outer end of machine 10. The opposite end of axle 126 extends through bearing 198 (FIG. 18) in sliding plate 192 and is coupled by a phase adjustment hub 182 to the Schmidt offset coupling 180, in turn, coupled to the main drive shaft 184 of the machine. The offset coupling 180 allows the upper die roll 60 and axle 126 to move along the direction of slots 132 and 173 toward and away from lower die roll 50 and yet remain coupled to the main drive shaft 184 which need not be coaxially aligned with axle 126. The phase adjusting hub 182 allows die roll 60 to be rotatably adjusted to provide precise alignment of the respective die cavities 100 (FIGS. 3 and 4) in die rolls 50 and 60, such that a preform 12 deposited over a cavity in die roll 50 is precisely aligned at the nip 55 with the corresponding cavity in die roll 60.

For purposes of removing the outer plate 170 of the die roll assembly section of machine 10, upper and lower pairs of jack screws 230 and 232 (FIG. 1) are provided at the upper and lower ends of outer plate 170 to assist when the threaded fasteners 231 securing plate 170 to the upper cross plate 172 and lower cross plate 174 are removed. A threaded locking knob 199 (FIG. 18) holds each of the die rolls 50, 60 onto their respective axles 124, 126 and allows removal of the die rolls. Once loosened, plate 170 can be urged away from the axle 126 of die roll 60 and axle 124 of die roll 50 for access to replace the die rolls in the event replacement becomes necessary due to wear or if a different preformed shape is being employed for a particular encapsulating run.

The drive mechanism for controlling the gelatin-forming drums 32 and 44, the die rolls 50 and 60, and associated take-off rolls, idler rolls, and oiler rolls, together with the index roll 49 is controlled by use of timing belt drives together with the phase adjustment couplings, such as hub 182 (FIG. 18), and a second phase adjustment coupling 279 (FIG. 9) for the tablet-feeding mechanism, as described below. The timing belt drive system is best illustrated in FIGS. 9-12. The main drive for machine 10 comprises an electric motor 240, which has an output shaft coupled to a gear box 242 secured to the floor 160 of machine 10, as illustrated in FIGS. 9 and 10. The gear box includes an output drive shaft 144 (FIGS. 10 and 11) coupled to a belt drive pulley 146 (FIG. 11) to a main drive belt 250. Each of the various drive belts shown comprises a herringbone tooth belt, which is a commercially available Eagle PD type belt from Goodyear Tire & Rubber Company. The belt drive pulleys are engaged by each of the drive belts and include a similar herringbone tooth-pattern to mesh with the timing drive belts to assure precise coupling and timing of the various components synchronized by the timing belts.

Drive belt 250 engages the main drive shaft 184 through belt drive pulley 185 (FIG. 11) and adjustable idler pulleys 186. Shaft 184 extends through a bearing 187 in wall 150 and to similar bearings 188 in walls 140 and 155 (FIG. 12). Offset coupling 180 is secured to the end of drive shaft 184 using a conventional slot and key coupling and, in turn, is conventionally coupled to the phase adjustment hub 182. The outer wall or end plate 155 (FIG. 9) is secured to wall 150 by struts 156 and includes bearings 157 for supporting the ends of the various drive shafts including shafts 184 and 124.

The main drive shaft 184, which extends through walls 140 and 150 as best seen in FIG. 12, into a gear box defined by the space between walls 140 and 150 and a partition floor 162 therebetween. The gear box so defined includes a lubricating oil which covers the lower section of gear 360 which drives shaft 124. Mounted in the space between walls 140 and 150 is a split gear 300 which engages the drive gear 360 secured to lower die roll drive shaft 124. The split gear, sometimes referred to as an anti-backlash gear, is shown in detail in FIGS. 13-17 and comprises a pair of gears 310 and 320 positioned in facing contacting radial adjustable relationship. Each of the gears include a plurality of spokes 312. The purpose of split gear 300 when meshing with gear 360 is to provide a smooth interconnection between the two gears regardless of gear wear, such that dies 50, 60 are rotated in a synchronous manner with respect to one another.

Figure 13:
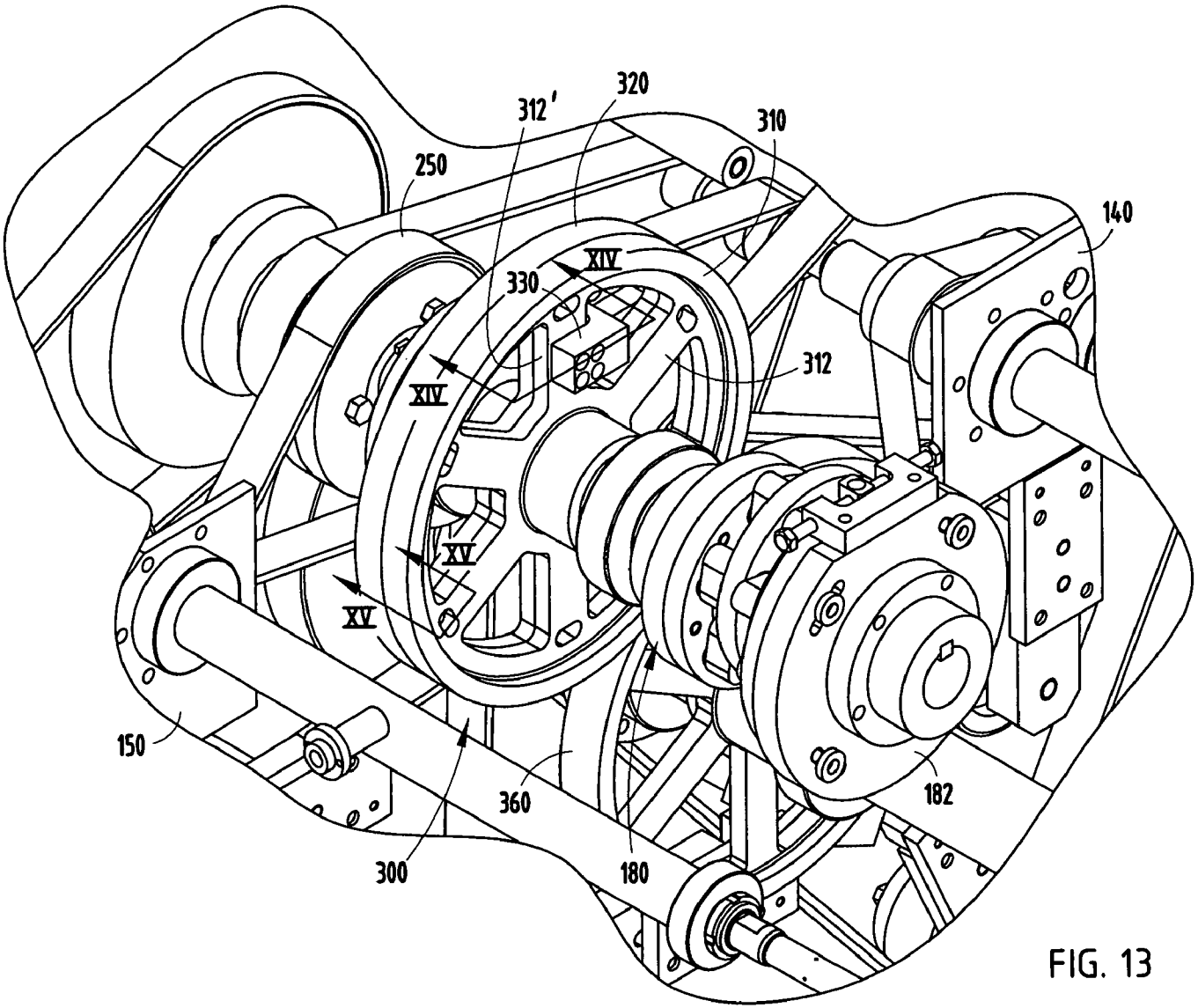
FIG. 13 is a fragmentary enlarged, partly broken away, perspective view of the upper and lower die roll drive mechanisms shown in FIG. 12.
Figure 15:
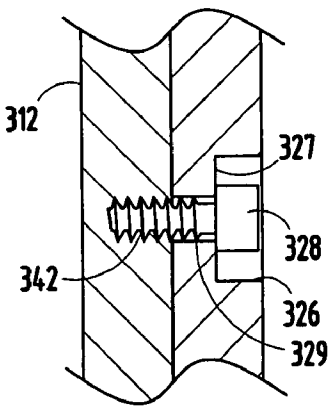
FIG. 15 is an enlarged cross-sectional view taken along section line XV-XV of FIG. 13.
Figure 14:
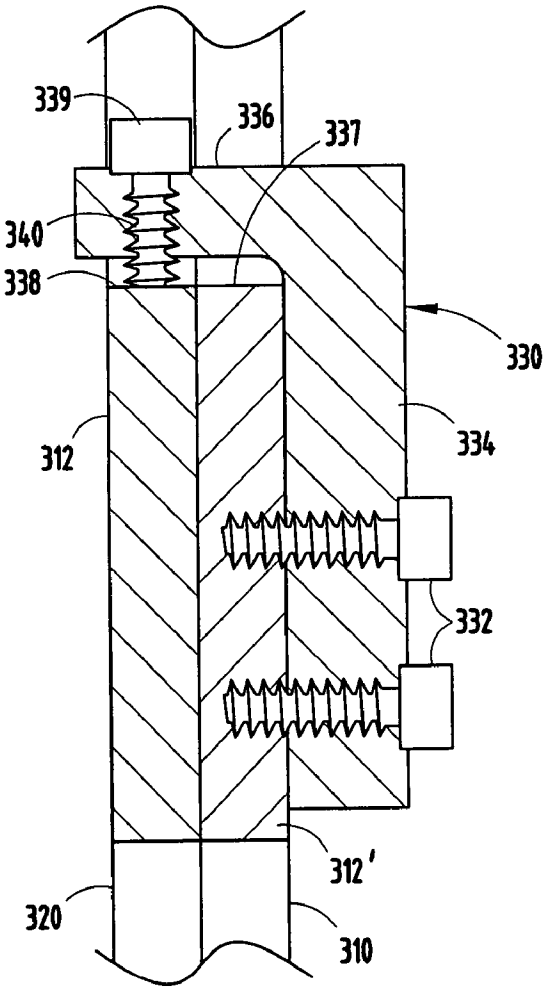
FIG. 14 is an enlarged fragmentary cross-sectional view taken along section line XIV-XIV of FIG. 13.
Figure 16:
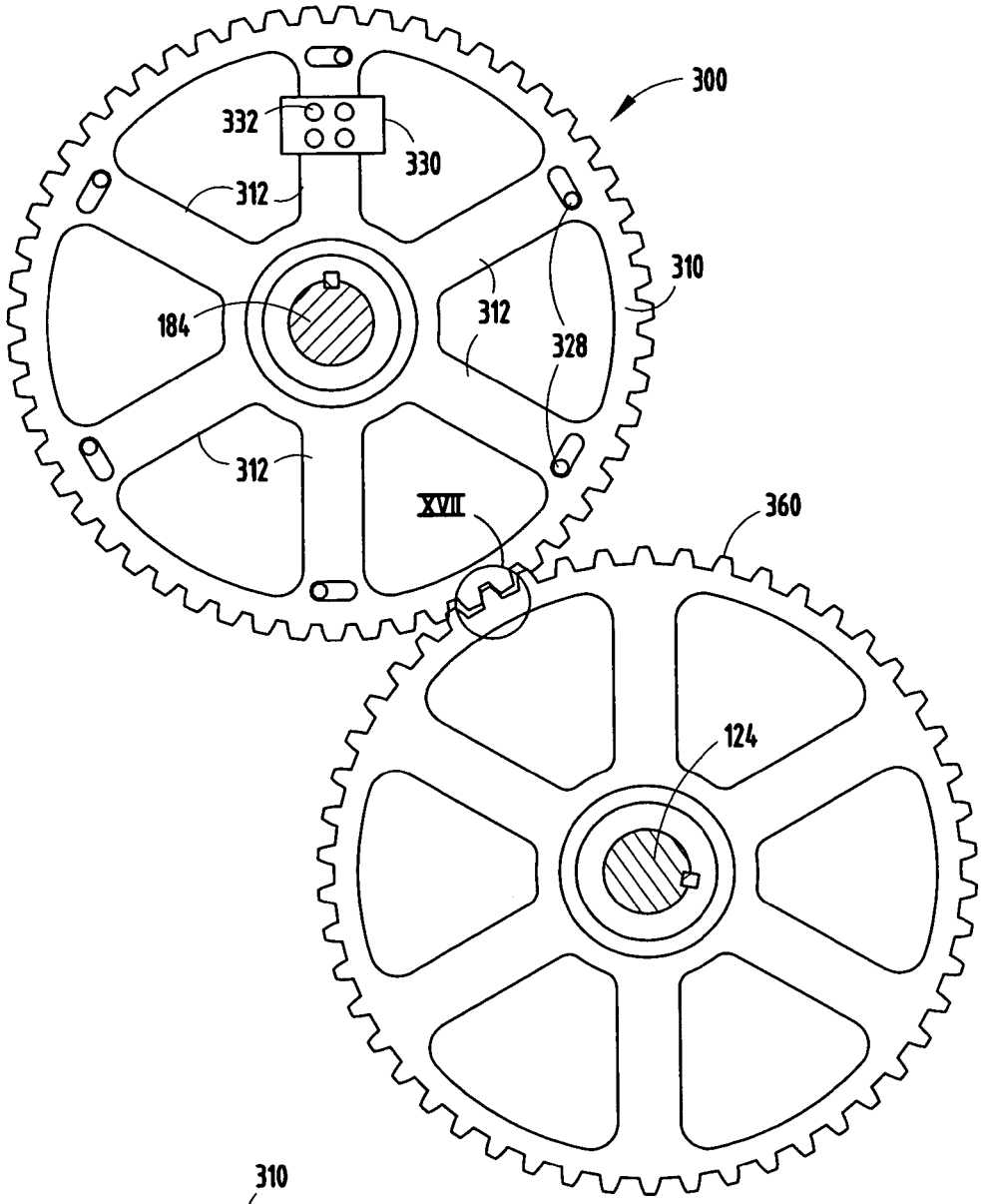
FIG. 16 is a fragmentary front elevational view showing the split gear drive for the upper die roll and the mating drive gear for the lower die roll.

The adjustment mechanism for adjusting split gear 300, including gear 310 with respect to gear 320, comprises an L-shaped adjustment bracket 330 (FIGS. 13, 14, and 16). Bracket 330 includes four locking screws 332 extending through clearance apertures in the elongated leg 334 of L-shaped bracket 330 and threaded into one of the spokes 312' of the front gear 310 (as seen in FIG. 13). The shorter leg 336 of bracket 330 extends between edges 337 of gear 310 and 320 of gear spoke 312 of gear 320, as best seen in FIG. 14. An adjustable set screw 339 is threaded through threaded aperture 340 in leg 336 and engages surface 338 for rotating gear 320 with respect to gear 310, such that the teeth 314 of gear 310 can adjustably overlap the teeth 324 of gear 320, as best seen in the enlarged view of FIG. 17.

Figure 17:
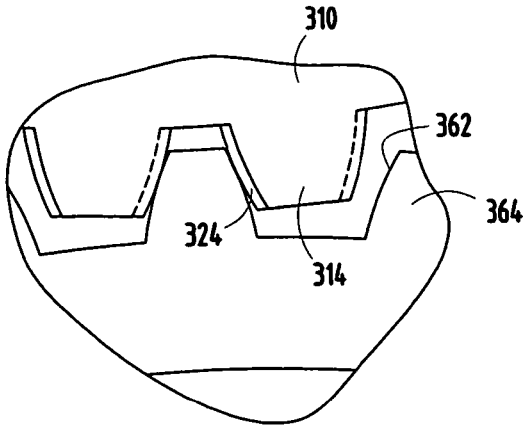
FIG. 17 is a greatly enlarged fragmentary front elevational view of the circled area XVII in FIG. 15.

A plurality of elongated slots 326 is provided in the spokes 312 of gear 310 and include a floor 327 for receiving the head of a locking cap screw 328, which extends through slotted aperture 326 and the mating aperture 329 in floor 327 into a threaded aperture 342 in each of spokes 312 of gear 320. Each of the six cap screws 328 are loosened prior to the adjustment of adjustment screw 339, and screw 339 is tightened until the desired effective width of gear teeth 314 and 324 is reached. After which, locking cap screws 328 are all tightened to securely fix gear 310 to gear 320 forming a close connection between the effective teeth formed by gear teeth 314 and 324 of gears 310 and 320 with the corresponding slots 362 between gear teeth 364 of mating gear 360 (FIG. 17). The effective width of gear teeth 314 and 324 is equal to the width W of the substantially identical width gears plus the overlap distance ΔW, which can be adjusted from 0 to about 0.010 inches and typically about 0.005 inches during use of the machine. Gears 300 and 360 in one embodiment had a diameter of about 10 inches and effect the counter rotation of die rolls 50 and 60.

The main drive shaft 184 also receives, as seen in FIG. 10, a drive pulley 252 which is coupled to a drive belt 254 extending to drive pulley 247 on drive shaft 248 of oiler roller 48 for casting drum 44, as seen in FIG. 1. An adjustable idler roller 249 maintains tension on belt 254. Shaft 248 also includes a drive pulley 256 (FIG. 11) which engages a drive pulley for a drive belt 258 which drives pulley 262 for the take-off roller drive shaft 245 which drives take-off roller 45 shown in FIG. 1. An adjustable idler pulley 255 maintains constant tension on drive belt 258.

The main drive shaft 184, as seen in FIG. 11, also includes a drive pulley 264 for receiving a drive belt 265 which is coupled to the casting drum drive pulley 266 for drive shaft 115 of casting drum 32. Adjustable idler pulleys 267 and 269 maintain constant tension on belt 265. Main drive shaft 184, as noted above, is gear coupled by the split gear 300 and mating gear 360 to drive shaft 124. Shaft 124 includes, as seen in FIG. 10, a drive pulley 268 which includes a drive belt 272 for the oiler drive shaft 274 for oiler roller 40, shown in FIG. 1. An adjustable pulley 275 maintains constant tension on belt 272 (FIG. 10). Shaft 124 also includes a drive pulley 276, as seen in FIG. 11, for receiving drive belt 278 which extends around casting drum 44 drive pulley 282 for the casting drum drive shaft 117. Adjustable idler pulleys 283 and 285 maintains a constant tension on drive belt 278. Shaft 124 also includes a drive pulley 284 (FIG. 11) for receiving drive belt 286 for the index roll drive shaft 288, with the tension on belt 286 being maintained constant by adjustable idler pulleys 289 and 291.

Drive belt 272, seen in FIG. 10, also drives the take-off drive belt 292 for take-off roller 38 (FIG. 1) by the use of a drive pulley 294 on shaft 274. Belt 292 engages a drive pulley 296 on drive shaft 298 for the take-off drive roller 38. An adjustable idler pulley 297 maintains constant tension on belt 292. Thus, the main drive belt 250 drives main drive shaft 184, which is coupled to secondary drive shaft 124 through the split gear 300 and mating gear 360 while drive shaft 124 and shaft 184 are coupled by synchronized drive belts to each of the take-off and oiler rollers, as well as the casting drums.

As noted above, drive shaft 124 drives the index roll 49 drive shaft 288 through belt 286 (FIG. 11). Shaft 288 extends through wall 130, as best seen in FIG. 9, and into phase adjustment coupling 279 to a drive belt 302 by means of a drive pulley 304 on shaft 288. Shaft 288 is supported by bearings 293 and 295 in walls 130 and 150, respectively, as seen in FIG. 9. Belt 302 drives through pulley 306 the drive shaft 59 for the index roll drive gear 54 shown in FIG. 1. An adjustable idler pulley 307 maintains constant tension on belt 302. Thus, the index roll 49 drive is also synchronized with both the shafts 124 and 184 for the die rolls with the timing drive belt and pulley connections and further synchronized with the use of phase adjusters 279 and 182. This allows precise alignment of preforms 12 from the index roll 49 onto the gelatin film 30 in alignment with the die cavities 100 in lower die roll 50 and the subsequent alignment of mating mold cavities 100 in die roll 60 for the encapsulation of preforms. After the gelatin films 30 and 70 exit the die rolls 50 and 60, they pass through the discharge chute assembly 80 and into the mangle roll assembly 400 which is now described.

Figure 19:
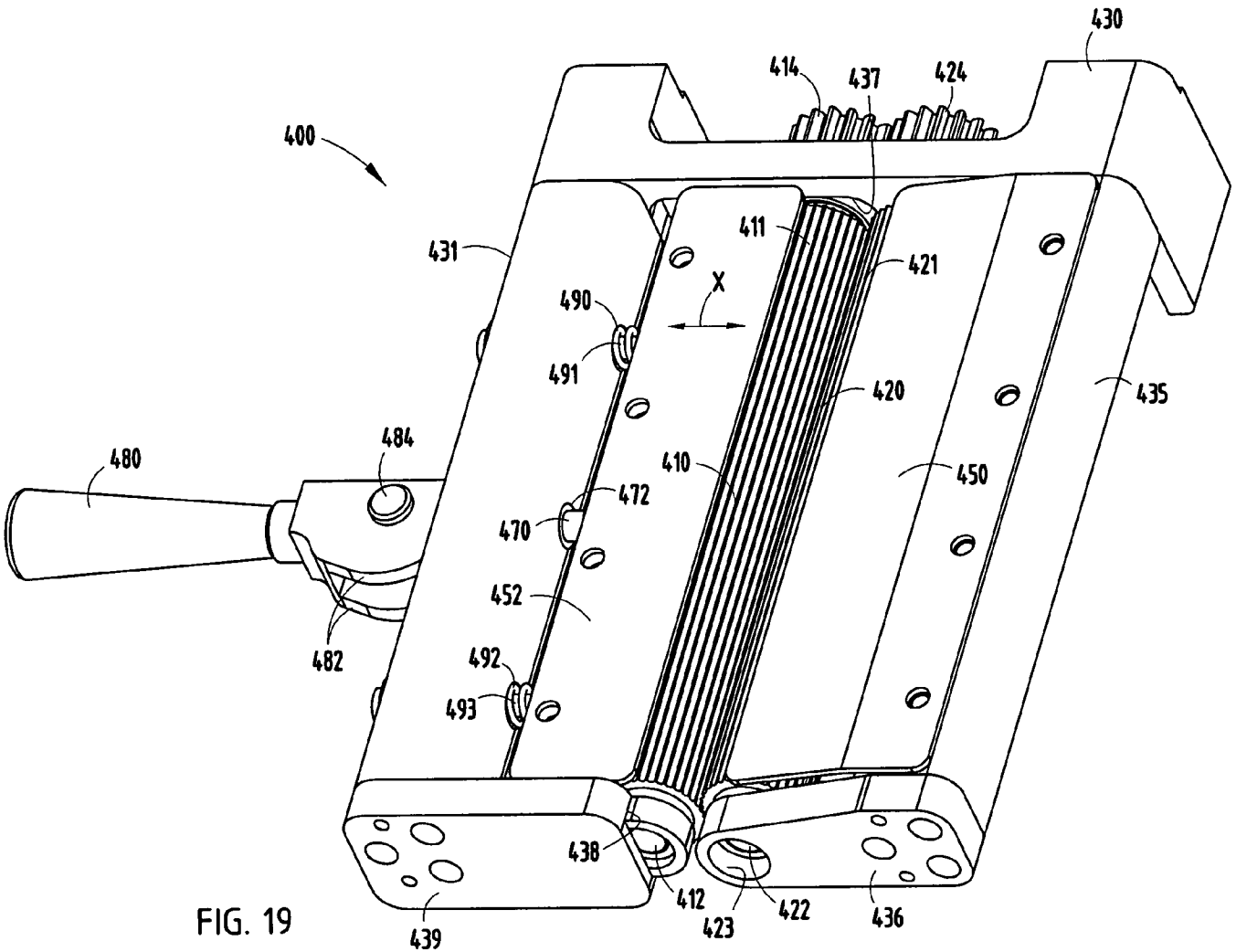
FIG. 19 is a perspective view of the mangle roll assembly, shown also in FIG. 1.

Mangle roll assembly 400 is shown in detail in FIGS. 19-21 and is mounted below the die rolls 50, 60 and chute assembly 80, as seen in FIG. 1, to receive the pairs of films 30, 70, which have been laminated into a web, once the encapsulated tablets have been removed from the web. The mangle roll assembly 400 comprises a pair of elongated rollers 410 and 420 rotatably mounted with respect to an inverted U-shaped frame 430 at one end. Roller 410 is rotatably mounted to a U-shaped frame 415 (FIG. 21), which is slidably mounted at one end in a slot 437 in frame 430 and a slot 438 in facing end plate 439 coupled to frame member 430 by cross strut 431. This allows roller 410 to move toward and away from roller 420 in a direction indicated by arrow X in FIGS. 19 and 21. Suitable bearings couple an axle 412 for roller 410 to the lateral legs 416 of U-shaped sub-frame 415. Axle 412 extends through member 430. Drive gear 414 meshes with a drive gear 424 on axle 422 associated with mangle roller 420. Frame 430 includes a pair of mounting slots 432 and 434 (FIG. 20) for mounting the mangle roll assembly to the front wall 130 of machine 10. A drive gear 440 (FIG. 20) engages gear 424 and is driven by a shaft 442 extending into the machine 10 and coupled to an adjustable speed drive motor (not shown) mounted to wall 130 for counter rotating rollers 410 and 420 at a speed to take up the web from the tablet discharge chute 80 (FIG. 1).

Figure 20:
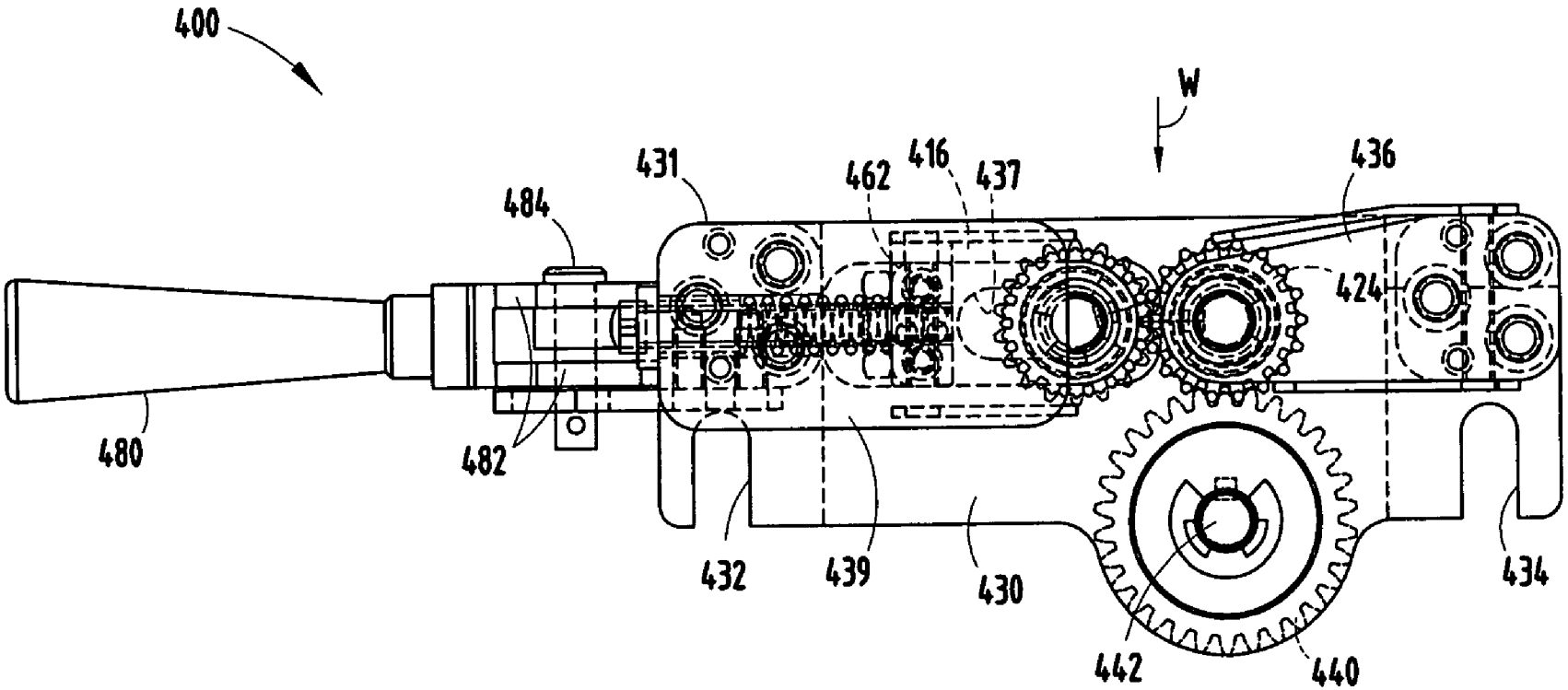
FIG. 20 is a front elevational view, partly in phantom form, of the mangle roll assembly shown in FIG. 19.
Figure 21:
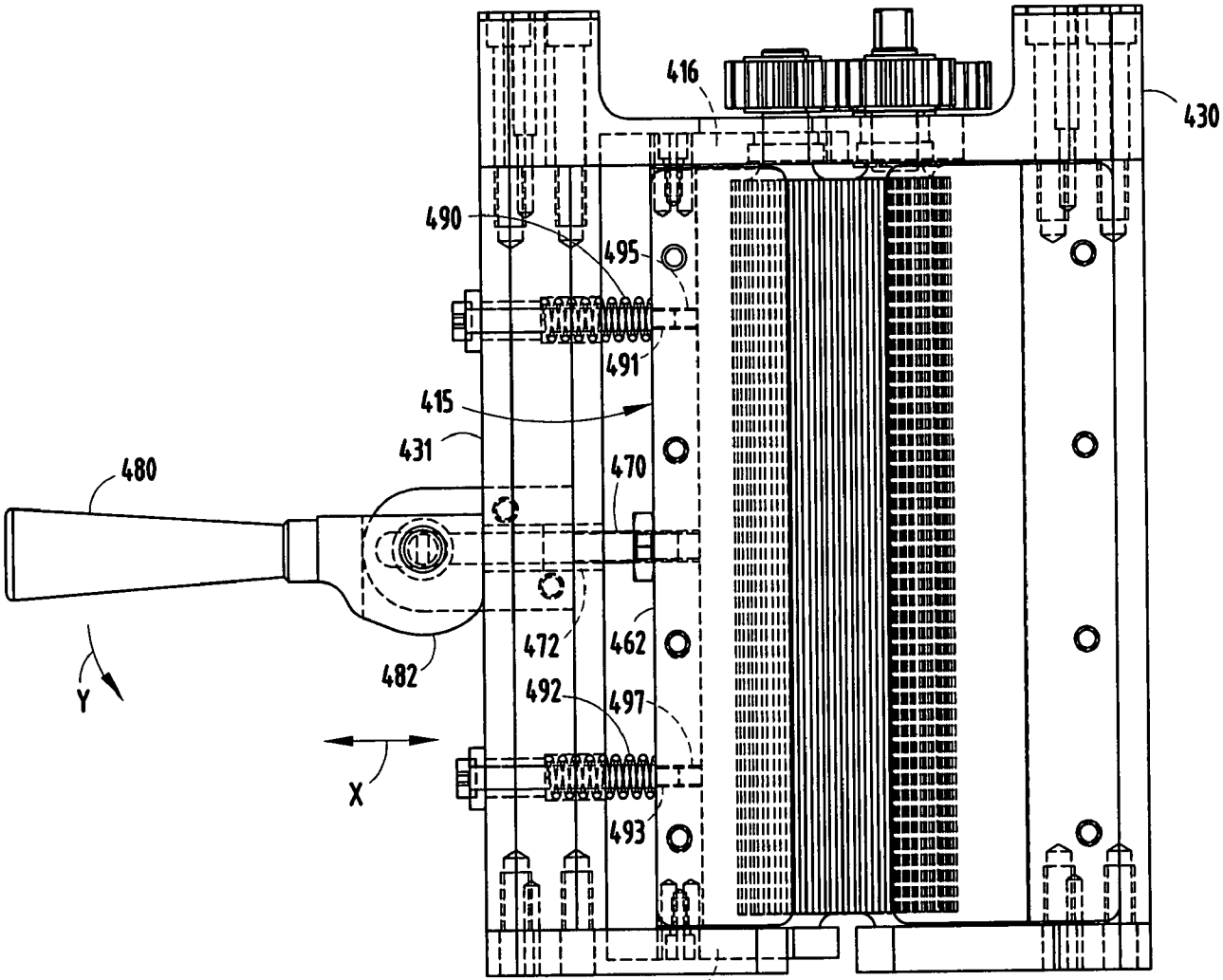
FIG. 21 is a top plan view of the mangle roll assembly shown in FIGS. 19 and 20.

The mangle rollers 410 and 420 each include meshing linear, elongated teeth 411 and 421, respectively, which, as best seen in FIG. 20, engage one another to receive a web (represented by arrow W in FIGS. 1 and 20) therebetween. The driven rollers, therefore, draw the web downwardly between the two rollers 410, 420, which are partially covered by protective guard 450 (mounted to partially cover roller 420, as shown in FIG. 25) and 452 (which partially covers roller 410). Guard 450 is mounted to cross strut 435, coupling an end plate 436, and frame 430 which supports axle 422 of roller 420 with a bearing 423. Guard 452 is secured to plate 462.

Roller 420 is mounted in rotatable relationship to frame 430 but is otherwise stationery with respect to the frame. Roller 410, however, is slidably mounted by frame 415 within slots 437 and 438 as noted above, such that it is allowed to move toward and away from roller 420 in the direction indicated by arrow X in FIGS. 19 and 21 to accommodate movements in the web or an occasional tablet which has not been freed from the web as it exits discharge chute 80. The movable U-shaped frame 415, shown partly in phantom form in FIG. 21, includes a moveable cross plate 462 with the roller bearings for shaft 412 being mounted to the legs 416 extending from opposite ends of cross plate 462. Plate 462 is coupled to a shaft 470 which extends through a bushing 472 in cross strut 431 extending between frame member 430 and end plate 439. Shaft 470 is threadably fixed at one end to cross plate 462 and engages a cam-operated handle 480 which includes camming surfaces 482 pivotally mounted by axle 484 thereto, such that handle 480 can be pivoted from the closed position, as shown in FIGS. 19 and 21, rotating in a direction indicated by arrow Y in FIG. 20 to urge roller 410 to the left, as shown in FIGS. 19 and 21, to disengage roller 410 from roller 420 to clear any jams that may inadvertently occur. Additionally, a pair of compression springs 490 and 492 extend over guide pins 491 and 493 with ends captively held in threaded apertures 495 and 497 in cross plate 462 (FIG. 21) to urge roller 410 into engagement with roller 420 when handle 480 is in a closed position, as illustrated in FIGS. 19-21. This provides a constant contact pressure between rollers 410 and 420 during normal operation.

As seen in the drawings and described above, the various driven elements of the machine are all interconnected through timing drive belts and belt drive pulleys to synchronize the casting of gelatin film, the depositing of preforms precisely onto the gelatin film 30 on die roll 50 and the meshing of the die rolls 50, 60 in precise alignment for encapsulating the preforms. By providing timing belts and associated drive pulleys which operate at a relatively slow speed and by the use of the phase adjustment hubs 279 and 182 and split gear 300 and by the selection of the diameters of the various drive pulleys, the motion of the casting drums 32 and 44 for the gelatin film, the die rolls 50 and 60 and the index roll 49 are precisely controlled and synchronized to assure maximum output of encapsulated product.

By providing the fulcrum adjustable spring 200 together with the offset drive 180 for at least one of the die rolls, the machine accommodates for die roll wear, gelatin thickness, and potential tablet misalignment. Further, by providing timing belt drives and the phase control couplings, the machine can be adjusted and synchronized for correct and efficient operation. By providing jack screws to the die roll mounting plates, the die roll changing is greatly facilitated inasmuch as the plates can be easily removed for access to the die rolls when changing tablet shapes or replacing worn dies. Although the upper die roll is shown in the preferred embodiment as being adjustable, the lower die roll can be the adjustable die roll and/or both die rolls can be mounted as described in connection with the upper die roll 60 of machine 10 if desired. By the improved configuration of the mold die cavities including a step-cut in the curvilinear land areas, improved sealing of caplets and tablets is achieved. Further, by providing mating rub rails on each of the die rolls, improved wear of the dies is achieved. Finally, the web, as it is discharged from the die rolls, is collected by an improved mangle roll assembly which is jam resistant and, in the event of a jam of web material, can easily be cleared by opening the mangle roll assembly without causing inefficient down time of the operation of the machine.

It will become apparent to those skilled in the art that various modifications to the preferred embodiments of the invention as described herein can be made without departing from the spirit or scope of the invention as defined by the appended claims.

The invention claimed is:

1. Improved die cavities in a die roll assembly for use in connection with the encapsulation of performs by plastic films traveling between a pair of die rolls, wherein the improvement in said cavities comprises:

a plurality of die cavities formed in said die rolls, wherein each of said die cavities includes a recess for receiving a perform therein, wherein said recess includes a floor and a side wall connected to the floor and defined by a land raised relative the surfaces of the dies defining the boundaries of recess, said land including two rounded peripheral sections connected to two straight peripheral sections, and wherein the land has a step-cut facing inwardly relative the cavity center formed in only said rounded peripheral sections extending initially downwardly from said land toward said floor of said recess a first predetermined distance and then orthogonally laterally inwardly a second predetermined distance substantially the same as said first predetermined distance to define a sealing area adjacent the land of said recess to admit film to be sealed around a preform placed in said recess.

2. The die roll assembly as defined in claim 1 wherein said step-cut defines a sharp cutting edge at the land extending around the periphery of said cavity.

3. The die cavities as defined in claim 2 wherein said film is a gelatin film.

4. The die cavities as defined in claim 3 wherein said die cavity is caplet-shaped and said first predetermined distance of said step-cut is about 0.007 inches.

5. The die cavities as defined in claim 4 wherein said second predetermined distance is about 0.010 inches.

6. The die cavities as defined in claim 3 wherein said first predetermined distance is about 64% of the initial thickness of said gelatin film.

7. The die cavities as defined in claim 6 wherein said die cavity is round and said first predetermined distance of said step-cut is about 0.007 inches.

8. The die cavities as defined in claim 7 wherein said second predetermined distance is about 0.006 inches.

9. A die roll assembly for encapsulating medicament preforms with gelatin comprising:

a pair of die rolls including mating die cavities for receiving preforms therein;

a pair of gelatin films supplied to said die rolls for encapsulating said preforms, wherein each mating cavity of each of the die rolls includes a recess for receiving a preform therein, wherein said recess has a floor and a side wall connected to the floor and defined by a land raised relative the surfaces of the die rolls defining the boundaries of recess, said land including two rounded peripheral sections connected to two straight peripheral sections, and wherein the land has a step-cut facing inwardly relative the cavity center formed in only said rounded peripheral sections extending initially downwardly from said land toward said floor of said recess a first predetermined distance and then orthogonally laterally inwardly a second predetermined distance to define a sealing area adjacent the land of said recess to admit said film to be sealed around a preform placed in said recess by said die rolls.

10. The die roll assembly as defined in claim 9 wherein said step-cut defines a sharp cutting edge at the land extending around the periphery of said cavity.

11. The die roll assembly as defined in claim 10 wherein said die cavity is caplet-shaped and said first predetermined distance of said step-cut is about 0.007 inches.

12. The die roll assembly as defined in claim 11 wherein said second predetermined distance is about 0.010 inches.

13. The die roll assembly as defined in claim 9 wherein said first predetermined distance is about 64% of the initial thickness of said gelatin film.

* * * * *

UNITED STATES PATENT AND TRADEMARK OFFICE

CERTIFICATE OF CORRECTION

PATENT NO. : 7,228,676 B2
APPLICATION NO. : 10/899924
DATED : June 12, 2007
INVENTOR(S) : Davis et al.

It is certified that error appears in the above-identified patent and that said Letters Patent is hereby corrected as shown below:

Claim 1, Column 12, line 3, “performs” should be --preforms--; and
Claim 1, Co1umn 12, line 8, “perform” should be --preform--.

Signed and Sealed this

Eleventh Day of December, 2007

JON W. DUDAS
*Director of the United States Patent and Trademark Office*